United States Patent [19]

Schneeberger et al.

[11] 4,235,682

[45] Nov. 25, 1980

[54] SEALING SOLUTION AND PROCESS TO PREVENT DEPOSITS FORMING DURING THE SEALING OF ANODIZED ALUMINUM SURFACES

[75] Inventors: Fritz Schneeberger; Walter Zweifel, both of Schaffhausen; Hermann Weber, Neuhausen, all of Switzerland

[73] Assignee: Swiss Aluminium Ltd., Chippis, Switzerland

[21] Appl. No.: 67,437

[22] Filed: Aug. 20, 1979

[30] Foreign Application Priority Data

Sep. 7, 1978 [CH] Switzerland ..... 9400/78

[51] Int. Cl.[3] ..... C25D 11/18

[52] U.S. Cl. ..... 204/35 N; 148/6.27

[58] Field of Search ..... 204/35 N, 38 A; 427/338, 419 A; 148/6.27

[56] References Cited

U.S. PATENT DOCUMENTS 3,671,333 6/1972 Mosier ..... 148/6.27

FOREIGN PATENT DOCUMENTS 231564 of 1925 United Kingdom ..... 427/338

OTHER PUBLICATIONS

Hackh's Chemical Dictionary, 4th Edition, McGraw-Hill Book Co. New York, pp. 19, 293–294.

*Primary Examiner*—Howard S. Williams
*Assistant Examiner*—William Leader
*Attorney, Agent, or Firm*—Bachman and LaPointe

[57] ABSTRACT

The solution for sealing anodic oxidized aluminum or aluminum alloys comprises basically an aqueous solution containing an addition of 0.1 to 2.5 g/l, made up of Agar-Agar and gelatine. the optimum pH value for the solution lies between 5.5 and 6.0.

The sealing is carried out at a temperature between 90° C. and the boiling point of the solution.

6 Claims, No Drawings

SEALING SOLUTION AND PROCESS TO PREVENT DEPOSITS FORMING DURING THE SEALING OF ANODIZED ALUMINUM SURFACES

BACKGROUND OF THE INVENTION

The invention relates to a sealing solution for the treatment of anodized aluminum or aluminum alloys comprising basically an aqueous solution, and relates also to a process for preventing deposits forming on the anodized surface during the sealing operation.

Anodizing is a surface treatment which is widely used with aluminum and its alloys. The oxide layer produced in this treatment considerably improves the resistance of the surface towards corrosive media. The natural or subsequent purposeful coloring of the oxide can also be used to provide a decorative finish to the part in question. One particularly important improvement from the technical point of view is that the oxide layer produced by anodizing increases the wear resistance of the surface of the aluminum.

There are various anodizing processes which can be used, depending on the properties required and the application in question. The most widely used of these is the so-called standard process employing direct current and solutions with sulphuric acid as the basis, and also another version in which oxalic acid is used.

There are also various processes for coloring the anodized surfaces, for example currentless coloring in solutions of organic or inorganic coloring agents, or electrolytic coloring with alternating current and solutions containing metal salts.

Oxide layers produced by anodizing do not, however, satisfy all requirements without some further treatment. The layers are porous, do not offer sufficient corrosion protection, and if colored, may have the colorant washed out of them again. The oxide, therefore, has to be sealed. This so called sealing process is usually carried out in hot or boiling water, if necessary with certain additions made to the water. As a result of this process, the pores are closed off, providing improved corrosion resistance and entrapping the colorant securely in the oxide.

The hydration of the aluminum oxide during the sealing process not only causes the pores to be closed off, but also results in the formation of a velvet so called sealing deposit on the surface. This deposit from the hydrated oxide impairs in particular the decorative appearance of dark colored oxide layers. Because the specific surface area is increased, this deposit also impairs the corrosion resistance and leads to discoloring of the surface. This sealing deposit is usually removed by mechanical polishing which of course entails extra labor and therefore considerable costs.

For some years now there have been processes which allow anodized surfaces to be sealed without the formation of a sealing deposit.

In the German patent DE-OS No. 14 46 461 for example a sealing solution containing basically nickel acetate and lignin sulphonate is described. It is also representative of the state of the art to prevent sealing deposits forming during the sealing process by using solutions which contain dextrin as an important constituent (DE-OS No. 19 44 452). The sealing bath in accordance with DE-OS No. 20 62 661 contains as the main constituents a water soluble nitrogen compound in combination with one or more of the substances dextrin, acrylic-acids or polyacrylate and lignin sulphonic acid.

In the process disclosed in the patent DE-OS No. 21 08 725 the sealing bath used contains, besides nickel acetate and/or cobalt acetate, the ammonium salt of naphthaline sulphonic acid as a dispersion agent, sodium lauryl sulphate and octyl-phenoxy-polyethoxyethanol as wetting agent and malic acid as buffer. A further process makes use of an aqueous solution containing additions of oxy-carbonic acids or their salts (DE-OS No. 21 62 674).

The patent DE-OS No. 22 11 553 proposes a sealing bath containing, besides calcium ions, one or more water soluble phosphonic acids or their salts which form complexes with divalent metals. From patent DE-OS No. 22 07 681 it is also known to carry out the sealing process in a gelatine solution.

The sealing baths belonging to the present state of the art are characterized by way of a broad spectrum of additive substances. The reason for this wide variety of agents is that up to now it has not been possible to achieve sealing without hindrance from deposits, without impairing the quality of sealing achieved. Often the values of measurements which characterize the oxide layer were completely satisfactory when measured immediately after the sealing operation. Components of the sealing bath trapped in the pores of the oxide layers can however markedly affect the behavior of these layers over the long term; often it is not until months later that diminished corrosion resistance becomes apparent e.g. in the form of "chalking" of the previously deposit-free surface. Certain additives tend to produce a yellowing under the influence of light. Others remain partially as an adherent residue on the surface after drying; this then calls for a further rinsing step.

It is therefore an object of the invention to provide a sealing solution for anodically oxidized aluminum or aluminum alloys comprising basically an aqueous solution and a process which prevents the formation of deposits during the sealing of anodized aluminum, at the same time without having the above mentioned disadvantages.

SUMMARY OF THE INVENTION

This object is fulfilled by way of the invention in that the sealing solution contains an addition of 0.1 to 2.5 g/l comprising:

(a) at least 10% Agar-Agar (b) 0 to at most 90% gelatine and the pH of the bath solution lies between 5 and 7.

The addition can be solely Agar-Agar, the optimum concentration range being between 0.5 and 1.5 g/l, preferably between 0.7 and 1.1 g/l.

In accordance with a particularly advantageous version of the sealing bath of the invention the addition comprises both Agar-Agar and gelatine with the Agar-Agar constituting 30 to 90%. The presence of Agar-Agar and gelatine simultaneously in the sealing bath has surprisingly, compared with the individual implementation of these substances, a considerable improvement with respect to the prevention of sealing deposits, the sealing quality, residues on drying and the long term corrosion properties, apparently due to a synergistic effect of these substances.

Extensive trials in production have shown that it is advantageous to use an addition containing 40–70% Agar-Agar in a concentration range of 0.2–0.9 g/l, preferably 0.3–0.6 g/l.

Independent of the concentration of the addition made, the pH of the sealing bath is to be adjusted to 5.5–6.0.

The process of the invention for preventing deposits forming during the sealing of anodized aluminum comprises sealing with the bath in accordance with the invention in a conventional method at temperatures between 90° C. and boiling point, preferably at least at 95° C.

DETAILED DESCRIPTION

The advantages of the present invention will now be explained in greater detail with the help of the example which follows and results from investigations.

EXAMPLE

The material used for investigation purposes was sheet material of the aluminum base alloy AlMg 1.5 in the half-hard condition and measuring 100 mm×50 mm×2 mm. The sheets were given a 1 min. caustic etching treatment in an aqueous solution of 150 g/l NaOH at 50° C. They were then anodized in the classical direct current-sulphuric acid process at a constant current density of 1.5 A/dm$^2$. The electrolyte, an aqueous solution of 176 g/l $H_2SO_4$ with an aluminum content of 7 g/l, was kept constant at a temperature of 20°±/1° C. The duration of the anodizing treatment was 40 min., which corresponds to an oxide layer thickness of about 20 μm. A part of this colorless anodized material was then colored black in a conventional manner using an organic coloring agent (Sanodal MLW, black), and another part colored dark brown, electrolytically in a metal salt solution (Colinal 3100) using alternating current.

The anodized and colored samples were then placed in de-ionized water, the pH adjusted to a valve between 5.5 and 6.0 using acetic acid or ammonia, kept there for 40 minutes—corresponding to 2 min per 1 μm of layer thickness—at a temperature of 98°±2° C. to seal the oxide layer. The composition of the additions in wt% were increased in steps of 20% from 100% Agar-Agar+0% gelatine to 0% Agar-Agar+100% gelatine. The concentration of the additive in the solution were 0.1, 0.2, 0.4, 0.6, 0.8, 1.0, 1.2, 1.5, 2.0 and 2.5 g/l.

To judge the quality of the sealed sheet, the criteria listed in Table I were employed, along with the testing methods also listed there.

The results of the investigations are summarized in Table II. These show:

Table II: Deposit on the black colored samples. The sheets were rubbed on one place with a rough black cloth. The assessment of the coating was based on the visual appearance of the sheet and on the residues on the cloth. The values used for the rating range from 0 (no deposit) to 5 (very pronounced deposit). In order to assess the sheets with respect to deposits after drying, the sheets were dipped briefly in de-ionized water after sealing.

Table III: Drying residues on dripped and air-dried sheet. The evaluation in this test was based on the visual assessment of residues (+) or no residues (−). The residues after drying appeared in the form of streaks from drip drying.

Table IV: Apparent conductivities in S as in ISO-DIS 2931

Table V: Weight loss in mg/dm$^2$ in the dissolution test as in ISO-DIS 2932.

Table VI: Evaluation of the color drip test as in ISO-R 2143. The rating scale ranges from 0 (very good) to 5 (very bad).

Table VII: Evaluation of an accelerated corrosion test as in DIN SO 947. The rating ranges from 0 (no visible corrosive attack) to 5 (pronounced pitting).

Table VIII: Evaluation of an accelerated corrosion test as in DIN 29 596 (Kesternich test). The test lasted 20 rounds. The rating scale ranges from 0 (no visible corrosive attack) to 5 (very pronounced attack).

Table IX: Corrosion resistance after 2 years open air exposure to a mild industrial atmosphere. In none of the versions investigated was there any significant corrosive attack. While some versions were still free of deposits after 2 years (−), others exhibited a black deposit (+).

The test for the resistance to UV light was carried out under a UV lamp Hanau TQ 150 at a distance of 30 cm. After 1500 hours no yellowing could be detected in any of the versions being investigated.

With the exception of the test for sealing deposits made on the black colored oxide layer, all tests were made on colorless oxide layers.

In two further sealing baths, instead of using de-ionized water for the basic solution, tap water and tap water containing 2 g/l nickel acetate and cobalt acetate were employed for comparison purposes. The results from a number of sheets tested after sealing in these baths are presented in table X.

The results obtained from the tests carried out in this example show that Agar-Agar and gelatine are very satisfactory as additives for sealing baths, both with respect to sealing quality and the prevention of deposit formation. The advantages of the sealing bath and process of the invention lie however in the synergistic effect of Agar-Agar and gelatine. This is expressed both in the tests for sealing quality and in the much wider concentration ranges within which anodic oxidized aluminum surfaces can be sealed without the formation of deposits and without risk of drying residues. This wide concentration range represents an extra safety factor in sealing bath maintenance in large anodizing plants.

A further advantage of the sealing bath of the invention lies in the long lifetimes and the possibility to use tap water as the basis of the bath, both points having been demonstrated in trials closely related to actual production conditions.

TABLE I

| Criterion | Test |
|---|---|
| Sealing deposit | Visual inspection, rubbing with a black cloth (residue) |
| Drying residues | Visual inspection |
| | Apparent conductivity as in ISO-DIN 2931 |
| | Weight loss as in dissolution test (ISO-DIS 2932) |
| Sealing quality | Color drip test as in ISO-R 2143. Accelerated corrosion test as in DIN 50 947 |
| | Accelerated corrosion test as in LN 29 596 (Kersternich) |
| Resistance to light | UV-Radiation |
| Long term corrosion behavior | Outdoor exposure to a mild industrial atmosphere |

TABLE II

| | | Composition of the addition in weight % Agar-Agar (A)/Gelatine (G) | | | | | |
|---|---|---|---|---|---|---|---|
| | | 100A/0G | 80A/20G | 60A/40G | 40A/60G | 20A/80G | 0A/100G |
| Concentration of the addition (g/l) | 0.1 | 3 | 1 | 1 | 1 | 1 | 4 |
| | 0.2 | 2 | 0 | 0 | 0 | 0 | 4 |
| | 0.4 | 1 | 0 | 0 | 0 | 0 | 2 |
| | 0.6 | 0 | 0 | 0 | 0 | 0 | 1 |
| | 0.8 | 0 | 0 | 0 | 0 | 0 | 0 |
| | 1.0 | 0 | 0 | 0 | 0 | 0 | 0 |
| | 1.2 | 0 | 0 | 0 | 0 | 0 | 0 |
| | 1.5 | 0 | 0 | 0 | 0 | 0 | 0 |
| | 2.0 | 0 | 0 | 0 | 0 | 0 | 0 |
| | 2.5 | 0 | 0 | 0 | 0 | 0 | 0 |

TABLE III

| | | Composition of the addition in weight % Agar-Agar (A)/Gelatine (G) | | | | | |
|---|---|---|---|---|---|---|---|
| | | 100A/0G | 80A/20G | 60A/40G | 40A/60G | 20A/80G | 0A/100G |
| Concentration of the addition (g/l) | 0.1 | – | – | – | – | – | – |
| | 0.2 | – | – | – | – | – | – |
| | 0.4 | – | – | – | – | – | – |
| | 0.6 | – | – | – | – | – | – |
| | 0.8 | – | – | – | – | – | – |
| | 1.0 | – | – | – | – | – | + |
| | 1.2 | – | – | – | – | – | + |
| | 1.5 | – | – | – | – | + | + |
| | 2.0 | + | – | – | – | + | + |
| | 2.5 | + | + | + | + | + | + |

TABLE IV

| | | Composition of the addition in weight % Agar-Agar (A)/Gelatine (G) | | | | | |
|---|---|---|---|---|---|---|---|
| | | 100A/0G | 80A/20G | 60A/40G | 40A/60G | 20A/80G | 0A/100G |
| Concentration of the addition (g/l) | 0.1 | 11.0 | 10.5 | 10.5 | 11.5 | 9.5 | 11.0 |
| | 0.2 | 10.5 | 12.0 | 10.0 | 10.5 | 12.5 | 10.5 |
| | 0.4 | 11.0 | 11.0 | 10.0 | 11.0 | 11.5 | 10.5 |
| | 0.6 | 11.0 | 9.5 | 13.0 | 10.5 | 10.0 | 12.0 |
| | 0.8 | 11.5 | 11.0 | 11.5 | 8.5 | 12.0 | 11.5 |
| | 1.0 | 10.5 | 12.5 | 10.0 | 11.5 | 10.5 | 11.0 |
| | 1.2 | 10.5 | 11.0 | 11.0 | 12.5 | 11.5 | 17.0 |
| | 1.5 | 12.5 | 10.5 | 9.5 | 10.5 | 13.0 | 22.5 |
| | 2.0 | 17.5 | 11.0 | 11.5 | 11.0 | 14.5 | 28.0 |
| | 2.5 | 20.5 | 11.0 | 12.5 | 12.0 | 19.5 | 36.5 |

TABLE V

| | | Composition of the addition in weight % Agar-Agar (A)/Gelatine (G) | | | | | |
|---|---|---|---|---|---|---|---|
| | | 100A/0G | 80A/20G | 60A/40G | 40A/60G | 20A/80G | 0A/100G |
| Concentration of the addition (g/l) | 0.1 | 3.7 | 4.2 | 1.8 | 3.3 | 2.6 | 1.5 |
| | 0.2 | 4.3 | 0.9 | 2.1 | 1.8 | 1.3 | 7.3 |
| | 0.4 | 0.5 | 1.1 | 1.8 | 0.4 | 1.1 | 6.1 |
| | 0.6 | 0.2 | 0.8 | 0.5 | 0.6 | 1.5 | 1.5 |
| | 0.8 | 1.1 | 0.3 | 0.1 | 2.1 | 1.3 | 3.9 |
| | 1.0 | 3.6 | 1.2 | 0.8 | 0.9 | 4.2 | 3.3 |
| | 1.2 | 2.7 | 1.3 | 5.7 | 3.2 | 6.5 | 13.2 |
| | 1.5 | 2.2 | 3.1 | 0.2 | 2.1 | 11.2 | 27.1 |
| | 2.0 | 13.3 | 9.8 | 7.2 | 6.5 | 14.3 | 44.0 |
| | 2.5 | 22.1 | 19.7 | 15.0 | 17.5 | 30.3 | 58.6 |

TABLE VI

| | | Composition of the addition in weight % Agar-Agar (A)/Gelatine (G) | | | | | |
|---|---|---|---|---|---|---|---|
| | | 100A/0G | 80A/20G | 60A/40G | 40A/60G | 20A/80G | 0A/100G |
| Concentration of the addition (g/l) | 0.1 | 0 | 0 | 0 | 0 | 0 | 0 |
| | 0.2 | 0 | 0 | 0 | 0 | 0 | 0 |

TABLE VI-continued

| | | Composition of the addition in weight % Agar-Agar (A)/Gelatine (G) | | | | | |
|---|---|---|---|---|---|---|---|
| | | 100A/0G | 80A/20G | 60A/40G | 40A/60G | 20A/80G | 0A/100G |
| Concentration of the addition (g/l) | 0.4 | 0 | 0 | 0 | 0 | 0 | 0 |
| | 0.6 | 0 | 0 | 0 | 1 | 0 | 0 |
| | 0.8 | 0 | 0 | 0 | 0 | 0 | 0 |
| | 1.0 | 0 | 1 | 0 | 0 | 0 | 2 |
| | 1.2 | 0 | 0 | 0 | 1 | 1 | 3 |
| | 1.5 | 2 | 0 | 0 | 0 | 0 | 5 |
| | 2.0 | 2 | 1 | 0 | 0 | 1 | 5 |
| | 2.5 | 3 | 0 | 0 | 0 | 2 | 5 |

TABLE VII

| | | Composition of the addition in weight % Agar-Agar (A)/Gelatine (G) | | | | | |
|---|---|---|---|---|---|---|---|
| | | 100A/0G | 80A/20G | 60A/40G | 40A/60G | 20A/80G | 0A/100G |
| Concentration of the addition (g/l) | 0.1 | 0 | 0 | 0 | 1 | 0 | 0 |
| | 0.2 | 0 | 0 | 0 | 0 | 1 | 1 |
| | 0.4 | 0 | 0 | 0 | 0 | 0 | 0 |
| | 0.6 | 1 | 0 | 0 | 0 | 0 | 0 |
| | 0.8 | 0 | 1 | 1 | 0 | 1 | 1 |
| | 1.0 | 0 | 1 | 0 | 1 | 0 | 2 |
| | 1.2 | 1 | 0 | 0 | 0 | 0 | 3 |
| | 1.5 | 0 | 0 | 0 | 0 | 1 | 3 |
| | 2.0 | 2 | 0 | 0 | 1 | 2 | 5 |
| | 2.5 | 2 | 1 | 1 | 0 | 2 | 4 |

TABLE VIII

| | | Composition of the addition in weight % Agar-Agar (A)/Gelatine (G) | | | | | |
|---|---|---|---|---|---|---|---|
| | | 100A/0G | 80A/20G | 60A/40G | 40A/60G | 20A/80G | 0A/100G |
| Concentration of the addition (g/l) | 0.1 | 0 | 0 | 1 | 0 | 1 | 1 |
| | 0.2 | 0 | 0 | 0 | 1 | 0 | 0 |
| | 0.4 | 0 | 1 | 0 | 0 | 0 | 0 |
| | 0.6 | 1 | 0 | 0 | 0 | 1 | 0 |
| | 0.8 | 0 | 1 | 0 | 0 | 0 | 1 |
| | 1.0 | 0 | 0 | 1 | 1 | 0 | 0 |
| | 1.2 | 0 | 0 | 0 | 0 | 1 | 2 |
| | 1.5 | 1 | 0 | 0 | 0 | 1 | 3 |
| | 2.0 | 2 | 0 | 0 | 2 | 0 | 4 |
| | 2.5 | 3 | 1 | 0 | 0 | 2 | 4 |

TABLE IX

| | | Composition of the addition in weight % Agar-Agar (A)/Gelatine (G) | | | | | |
|---|---|---|---|---|---|---|---|
| | | 100A/0G | 80A/20G | 60A/40G | 40A/60G | 20A/80G | 0A/100G |
| Concentration of the addition (g/l) | 0.1 | + | + | + | + | + | + |
| | 0.2 | + | – | – | – | – | + |
| | 0.4 | – | – | – | – | – | + |
| | 0.6 | – | – | – | – | – | – |
| | 0.8 | – | – | – | – | – | – |
| | 1.0 | – | – | – | – | – | – |
| | 1.2 | – | – | – | – | – | + |
| | 1.5 | + | – | – | – | + | + |
| | 2.0 | – | – | – | – | + | + |
| | 2.5 | + | – | + | – | – | + |

TABLE X

| | | Sealing bath (with addition of 0.4 g/l) | | | | | |
|---|---|---|---|---|---|---|---|
| | | tap water | | | tap water with additions of 2g/l each of Ni-acetate and Co-acetate | | |
| | Oxide layer | 80A/ 20G | 60A/ 40G | 40A/ 60G | 80A/ 20G | 60A/ 40G | 40A/ 60G |
| Sealing deposit | colored dark brown | 0 | 0 | 0 | 0 | 0 | 0 |
| Color driptest | colorless | 2 | 0 | 1 | 0 | 0 | 0 |
| Openair exposure | colored dark brown | 2 | 1 | 1 | 1 | 0 | 1 |

What is claimed is:

1. Process to prevent deposits forming during the sealing of anodized aluminum or aluminum alloys with an aqueous sealing solution, in which process the sealing takes place at a temperature between 90° C. and the boiling point of the solution, and this sealing bath contains an addition of 0.1 to 2.5 g/l comprising:

(a) at least 10% Agar-Agar (b) 0 to at most 90% gelatine with the pH of the solution lying between 5 and 7.

2. Process according to claim 1 in which said temperature is between 95° C. and the boiling point of the solution.

3. Process according to claim 1 in which the sealing solution contains an addition of 100% Agar-Agar at a concentration of 0.5 to 1.5 g/l.

4. Process according to claim 1 in which the Agar-Agar in the addition constitutes 30 to 90%.

5. Process according to claim 1 in which the addition contains 40 to 70% Agar-Agar and is present in the solution at a concentration of 0.2 to 0.9 g/l.

6. Process according to claim 1 in which the pH of the solution lies between 5.5 and 6.0.

* * * * *

UNITED STATES PATENT AND TRADEMARK OFFICE

CERTIFICATE OF CORRECTION

PATENT NO. : 4,235,682

DATED : November 25, 1980

INVENTOR(S) : Fritz Schneeberger, Walter Zweifel and Hermann Weber

It is certified that error appears in the above-identified patent and that said Letters Patent are hereby corrected as shown below:

In the Abstract, line 4, after "gelatine." change "the" to read ---The---.

In Column 8, line 15, claim 5, change "claim 1" to read ---claim 4---.

Signed and Sealed this

*Tenth* Day of *March 1981*

[SEAL]

*Attest:*

RENE D. TEGTMEYER

*Attesting Officer*

*Acting Commissioner of Patents and Trademarks*